US011255170B2

(12) United States Patent
Zahran

(10) Patent No.: US 11,255,170 B2
(45) Date of Patent: Feb. 22, 2022

(54) SELF-PROPELLED PLUNGER FOR ARTIFICIAL LIFT

(71) Applicant: Saudi Arabian Oil Company, Dhahran (SA)

(72) Inventor: Amr Mohamed Zahran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/940,841

(22) Filed: Jul. 28, 2020

(65) Prior Publication Data

US 2021/0032964 A1 Feb. 4, 2021

Related U.S. Application Data

(60) Provisional application No. 62/879,855, filed on Jul. 29, 2019.

(51) Int. Cl.
*E21B 43/12* (2006.01)
*F04B 47/12* (2006.01)

(52) U.S. Cl.
CPC ..... *E21B 43/121* (2013.01); *F04B 47/12* (2013.01)

(58) Field of Classification Search
CPC ..... E21B 43/121; E21B 43/13; E21B 43/122; E21B 43/129; F04B 47/12
See application file for complete search history.

(56) References Cited

U.S. PATENT DOCUMENTS 2,038,426 A 4/1936 Fletcher
2,762,308 A 9/1956 Tomlinson
3,150,596 A * 9/1964 Knox ..... F04B 47/12 417/60
4,211,279 A 7/1980 Isaacks
6,148,923 A 11/2000 Casey
6,705,404 B2 3/2004 Bosley et al.
6,830,108 B2 12/2004 Rogers
6,966,366 B2 11/2005 Rogers
7,080,692 B1 7/2006 Kegin
7,188,670 B2 3/2007 Amies et al.
7,337,854 B2 3/2008 Horn et al.
(Continued)

FOREIGN PATENT DOCUMENTS

WO WO2016057011 4/2016

OTHER PUBLICATIONS

PCT International Search Report and Written Opinion in International Application No. PCT/US2020/043,851, dated Oct. 22, 2020, 14 pages.

*Primary Examiner* — George S Gray
(74) *Attorney, Agent, or Firm* — Fish & Richardson P.C.

(57) ABSTRACT

Artificial lift systems, methods, and apparatuses are described. An example artificial lift system may include a plunger have an energy-storing component to store energy as the plunger descends through a wellbore and release the stored energy as the plunger ascends through the wellbore. The energy-storage component may be a spring. The spring may be compressed in response to rotation of a propeller coupled to the spring. The propeller may rotate in a first direction in response to interaction of the propeller and a liquid in the wellbore as the plunger descends. The spring may expand during uphole movement of the plunger to rotate the propeller in a second direction, opposite the first direction, and assist in lifting the plunger to the surface.

17 Claims, 4 Drawing Sheets

(56) References Cited

U.S. PATENT DOCUMENTS

| | | | | |
|---|---|---|---|---|
| 8,181,706 | B2 | 5/2012 | Tanton | |
| 8,985,221 | B2 | 3/2015 | Mazzanti | |
| 9,206,676 | B2 | 12/2015 | Quigley et al. | |
| 9,322,251 | B2 | 4/2016 | Mazzanti | |
| 9,470,073 | B2 | 10/2016 | Xiao et al. | |
| 2003/0215337 | A1* | 11/2003 | Lee | E21B 43/121 417/56 |
| 2005/0194149 | A1* | 9/2005 | Giacomino | E21B 43/121 166/369 |
| 2006/0113072 | A1 | 6/2006 | Lee | |
| 2013/0319661 | A1 | 12/2013 | Xiao et al. | |

* cited by examiner

SELF-PROPELLED PLUNGER FOR ARTIFICIAL LIFT

CLAIM OF PRIORITY

This application claims priority to U.S. Provisional Patent Application Ser. No. 62/879,855, filed on Jul. 29, 2019, the entire contents of which is hereby incorporated by reference.

TECHNICAL FIELD

The present disclosure relates to artificial lift systems and, more particularly, to plunger lift systems.

BACKGROUND

Plunger lift systems are artificial lift systems. Plunger lift systems are used for oil production in oil wells that have a gas-liquid ratio that poses production difficulties for other artificial lift systems and deliquification of gas wells. Plunger lift systems use wellbore pressure and solid or flow through plungers to transport wellbore fluids to the surface.

SUMMARY

An aspect of the present disclosure is directed to a plunger lift system. The plunger lift system may include a housing defining an interior cavity and a spring positioned within the cavity. The housing may be configured to travel between a downhole position in a wellbore and a surface of the earth and configured to displace a volume of fluid uphole of the housing responsive to downhole wellbore pressure. The spring may be configured to transition from a compressed state to an expanded state during uphole travel of the housing to displace the volume of fluid uphole of the housing.

Another aspect of the present disclosure is directed to an artificial lift method. The artificial lift method may include lowering a plunger from a surface of the earth to a downhole position in a wellbore. The plunger may include a housing configured to travel between the downhole position and the surface; a cavity formed in the housing; and a spring positioned within the cavity. The artificial lift method may also include storing energy within the spring while lowering the plunger from the surface to the downhole position and releasing energy stored within the spring when the plunger travels uphole to displace a volume of fluid uphole of the plunger in response to downhole wellbore pressure.

A further aspect of the present disclosure is directed to an artificial lift method. The artificial lift method may include moving a plunger located at a downhole position in a wellbore in an uphole direction responsive to wellbore pressure to displace a volume of fluid uphole of the plunger and releasing energy stored within a spring disposed in the plunger while displacing the volume of fluid in the uphole direction, the released energy assisting to displace the volume of fluid in the uphole direction.

The various aspects may include one or more of the following features. A propeller may be configured to rotate in a first direction during downhole travel of the housing and in a second direction, opposite the first direction, during uphole travel of the housing. A shaft may be positioned within the housing. The shaft may include a first end coupled to the spring and a second end coupled to the propeller. The spring may be configured to compress in response to rotation of the propeller in the first direction and to expand in response to rotation of the propeller in the second direction.

A clutch may be coupled to the shaft. The clutch may be configured to change a direction of rotation of the propeller between the first direction and the second direction. The clutch may be configured to change the direction of rotation of the propeller from the first direction to the second direction when the housing reaches the downhole position in the wellbore and to change the direction of rotation of the propeller from the second direction to the first direction when the housing reaches the surface of the earth. A longitudinal axis of the spring and a longitudinal axis of the housing may be parallel to each other. The longitudinal axis of the spring and the longitudinal axis of the housing may be collinear. The interior cavity may be a first interior cavity. The housing may also defines a second interior cavity adjacent to the first interior cavity, and the propeller may be disposed in the second interior cavity. The first interior cavity and the second interior cavity may be separated by a partition. At least on slot may be formed in a portion of the housing circumscribing the second cavity.

The various aspects may also include one or more of the following features. The plunger may include a propeller configured to rotate in a first direction during lowering of the plunger and in a second direction, opposite the first direction, during the uphole travel of the plunger. A shaft may be positioned within the housing. A first end of the shaft may be coupled to the spring, and a second end of the shaft may be coupled to the propeller. The propeller may be rotated in a first direction during lowering of the plunger to store energy within the spring. The propeller may be rotated in a second direction, opposite the first direction, during the uphole travel of the plunger to release the stored energy within the spring. A direction of rotation of the propeller may be changed between the first direction and the second direction using a clutch coupled to the propeller. The direction of rotation of the propeller may be changed from the first direction to the second direction when the plunger reaches the downhole position in the wellbore and from the second direction to the first direction when the plunger reaches the surface. The spring may be a helical spring. Storing energy within the spring may include compressing the helical spring. Releasing the stored energy within the spring may include expanding the compressed helical spring.

The various aspects may also include one or more of the following features. Releasing energy stored within a spring disposed in the plunger while displacing the volume of fluid in the uphole direction may include rotating a propeller of the plunger using the released energy to assist in displacing the volume of fluid in the uphole direction. Rotating a propeller of the plunger using the released energy to assist in displacing the volume of fluid in the uphole direction may include expanding the spring to rotate the propeller of the plunger. Energy may be stored within the spring while the plunger descends in a downhole direction.

The details of one or more implementations of the present disclosure are set forth in the accompanying drawings and the description that follows. Other features, objects, and advantages of the present disclosure will be apparent from the description and drawings, and from the claims.

DETAILED DESCRIPTION

Figure 1:
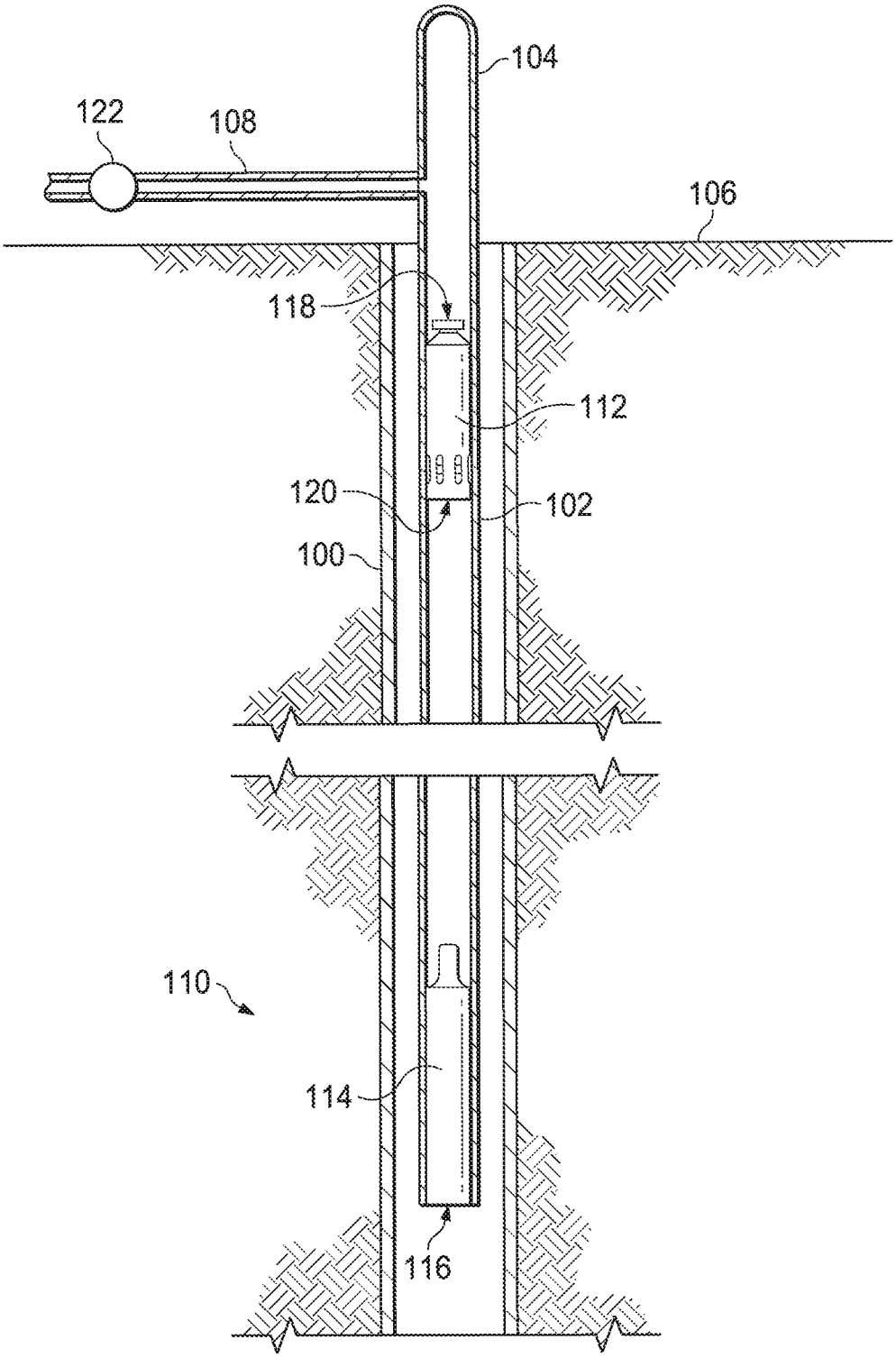
FIG. 1 is a plan view of a wellbore containing a completion string and an artificial lift system that includes a self-propelled plunger, according to some implementations of the present disclosure.

For the purposes of promoting an understanding of the principles of the present disclosure, reference will now be made to the implementations illustrated in the drawings, and specific language will be used to describe the same. Nevertheless, no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, steps, or a combination of these described with respect to one implementation may be combined with the features, components, steps, or a combination of these described with respect to other implementations of the present disclosure.

The present disclosure is directed to apparatuses, systems, and methods of artificial lift systems. Particularly, the present disclosure is directed to a self-propelled plunger of a plunger lift system. FIG. 1 shows a wellbore 100 and a completion string 102 disposed in the wellbore 100. A wellhead 104 is disposed at a surface 106 of the earth. A production line 108 is connected and in fluid communication with the wellhead 104. An artificial lift system 110 is disposed in the completion string 102. The artificial lift system 110 includes a self-propelled plunger 112 and a downhole component 114. The plunger 112 is oriented such that a first end 118 is disposed in an uphole orientation and a second end 120 of the plunger 112 is disposed in a downhole orientation. The downhole component 114 may include a bumper spring operable to absorb an impact imparted by the plunger 112 as the plunger 112 returns to a bottom 116 of the completion string 102. The plunger 112 is operable to ascend from the bottom 116 of the completion string 102 to the surface 106 of the earth in response to downhole pressure within the wellbore 100 and descend to the bottom 116 of the completion string 102 at a conclusion of a lifting cycle.

Figure 2:
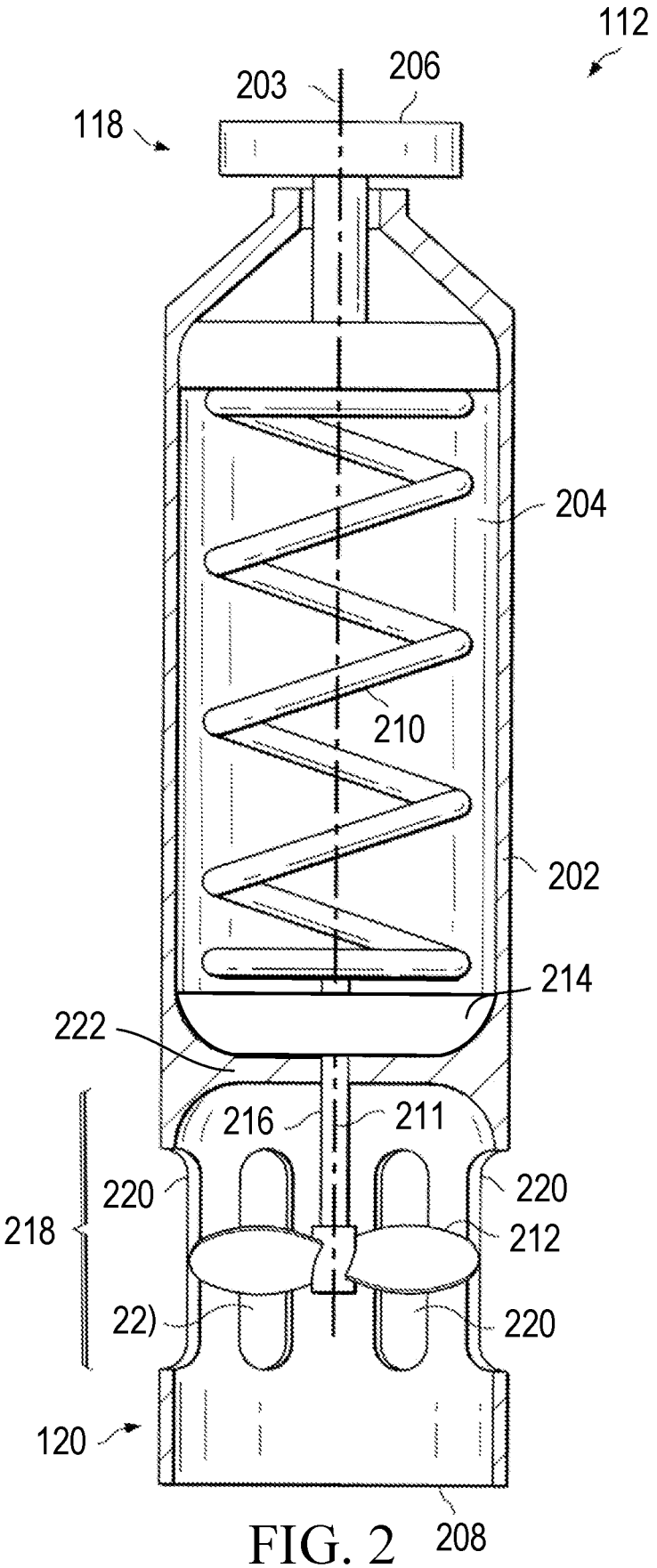
FIG. 2 is a partial cross-sectional view of an example self-propelled plunger showing internal workings of the plunger, according to some implementations of the present disclosure.

FIG. 2 is side a front view of the example self-propelled plunger 112. The plunger 112 includes a housing 202 defining an interior cavity 204, a nose piece 206 at the first end 118, and a tail piece 208 at the second end 120. The plunger 112 also includes a compressible spring 210 disposed within the interior cavity 204; a propeller 212 rotatable in response to movement of the plunger 112 within a fluid; a clutch 214 configured to releasably engage a shaft 216; and the shaft 216 that couples the propeller 212 to the spring 210. The propeller 212 is disposed at the second end 120.

As shown in FIG. 2, the propeller 212 is contained in an interior cavity 218 located adjacent to the second end 120 of the plunger 112. In the illustrated example, the cavity 218 is separated from the cavity 204, such as by a wall 222. A plurality of slots 220 are formed in a portion of the housing 202 that circumscribes the cavity 218. The slots 220 allow for ingress of liquid into the cavity 218. Engagement of the propeller 212 and liquid contained within the completion string 102 operates to rotate the propeller 212 both to compress the spring 210 and, accordingly, to store energy within the spring 210. As discussed below, the stored energy is used to lift the plunger 112 as the plunger 112 ascends uphole through the completion string 102. The stored energy is released to rotate the propeller 210 as the spring 210 expands.

The spring 210 is compressible, so as to store potential energy, and expandable, such that the stored potential energy is converted to kinetic energy. Springs with specific stiffness, length, and/or other spring parameters can be selected based on well parameters. Well parameters, for example well depth, expected fall time, and expected fall velocity, generally vary between wells.

In some implementations, when the plunger 112 is disposed in the completion string 102 at the surface 106, the spring 210 is in an expanded condition. When the plunger 112 is released from the surface 106, the plunger 112 descends downhole through the completion string 102 due to gravity. As the plunger 112 travels downhole, the plunger 112 may encounter a liquid, such as water or oil, within the completion string 102. Movement of the liquid around the propeller 212 causes the propeller 212 to rotate in a first direction. The shaft 216, being coupled to the propeller 212, also rotates, causing the spring 210 to compress. Thus, a portion of the kinetic energy of the falling plunger 112 is converted into potential energy that is stored within the compressed spring 210.

The clutch 214 is mounted to (or integral with) the housing 202 and is releasably engaged with the shaft 216. When engaged, the shaft 216 is rotatable relative to the clutch 214 in the first rotational direction (the charging, compressive direction) but is rotationally constrained to the clutch 214 in the second rotational direction. Such an engagement transfers the rotation of the propeller 212 in the first direction to the spring 210 to charge the spring 210, but prevents the spring 210 from preemptively rotating in the second direction (discharging, relaxing). In some plungers, the clutch is in a toothed engagement with the shaft, for example by a saw toothed pattern or splines. The engagement between the clutch 214 and the shaft 216 is described further with reference to FIG. 4.

The clutch 214 engages the shaft 216 while the plunger 212 lowers into the completion string 102. Once the plunger 212 reaches the bottom 116 of the completion string 102, the plunger 212 engages the downhole component 114, causing the shaft 216 to translate axially and disengage the clutch 214. The propeller 212 and shaft 216 are free to rotate in a first direction and in a second direction, opposite the first direction.

With the plunger 112 at the bottom 116 of the completion string 102, the plunger 112 may be released to return to the surface 106 at the occurrence of a predetermined event. For example, when the downhole wellbore pressure reaches a predetermined value, pressure is released, such as by opening a valve 122. In response to release of the pressure, the plunger 112 ascends to the surface 106, lifting a volume of fluid located uphole of the plunger 112, adjacent to the first end 118 of the plunger 112, to the surface 106.

As the plunger 112 ascends during uphole travel through the completion string 102, the spring 210 expands, causing the propeller 212 to rotate in the second direction. Rotation of the propeller 212 in response to the expanding spring 210 assists in lifting plunger 112 to the surface 106. Thus, as the plunger 112 ascends, potential energy stored in the compressed spring 210 is converting into kinetic energy. The spring 210, shaft 216, and propeller 212 act as a power source to assist in lifting the plunger 112 to the surface 106. The additional thrust provided by these components allows the plunger 112 to operate at reduced downhole wellbore pressures. That is, the plunger 112 is operable to lift a volume of fluid to the surface 106 at a reduced downhole pressure due to the additional thrust provided by the propeller 212 in response to expansion of the spring 210. In current artificial lift operations involving plunger lift, wells are typically shut in for a period of time to allow the downhole wellbore pressure to build. However, plungers within the scope of the present disclosure require a reduced shut in time period or no shut it time period, because the stored energy in the spring 210 provides energy to lift the plunger and the volume of fluid with little or no downhole wellbore pressure. More particularly, plungers within the scope of the present disclosure are operable to perform artificial lift operations (that is, cycling the plunger between the bottom of the completion string and the surface) in wellbore environments where reservoir energy levels are insufficient to cycle a conventional plunger to the surface. Consequently, artificial lift systems within the scope of the present disclosure operate to produce fluids from a reservoir where reservoir energy levels are insufficient to lift a conventional plunger to the surface.

As shown in FIG. 2, the housing 202 includes a longitudinal axis 203, and the spring 210 includes a longitudinal axis 211. In some implementations, the longitudinal axis 203 of the housing 202 is parallel with the longitudinal axis 211 of the spring 210. In still other implementations, the longitudinal axis 211 of the spring 210 is aligned with the longitudinal axis 203 of the housing 202, such that the longitudinal axis 203 and the longitudinal axis 211 are collinear.

When the plunger 112 arrives at the surface 106, the nose piece 206 is engaged, such as by the wellhead 104 or another component at the surface 106. Engagement of the nose piece 206 aligns and couples the clutch 214 with the shaft 216, permitting the propeller 212 and shaft 216 to rotate in the first direction and preventing rotation in the second direction.

The plunger 112 may remain at the surface 106 for a predetermined period of time or until the occurrence of a predetermined event. For example, the plunger 112 may remain at the surface 106 until the downhole pressure falls below a predetermined value. Upon occurrence of the predetermined event, the plunger 112 may be released to return to the bottom 116 of the completion string 102. In some implementations, release of the plunger 112 from the surface 106 may be performed by closing the valve 122. As the plunger 112 descends and encounters fluid within the completion string 102, the liquid and propeller 212 interact to cause the propeller 212 and shaft 216 to rotate in the first direction, thereby compressing the spring 210. Upon reaching the bottom 116 of the completion string 102, the plunger 112 engages the downhole component 114, reversing the clutch 214 to permit rotation of the propeller 212 and shaft 216 in the second direction and preventing rotation in the first direction. The plunger 112 may remain at the bottom 116 of the completion string 102 until the predetermined event reoccurs.

Figure 3:
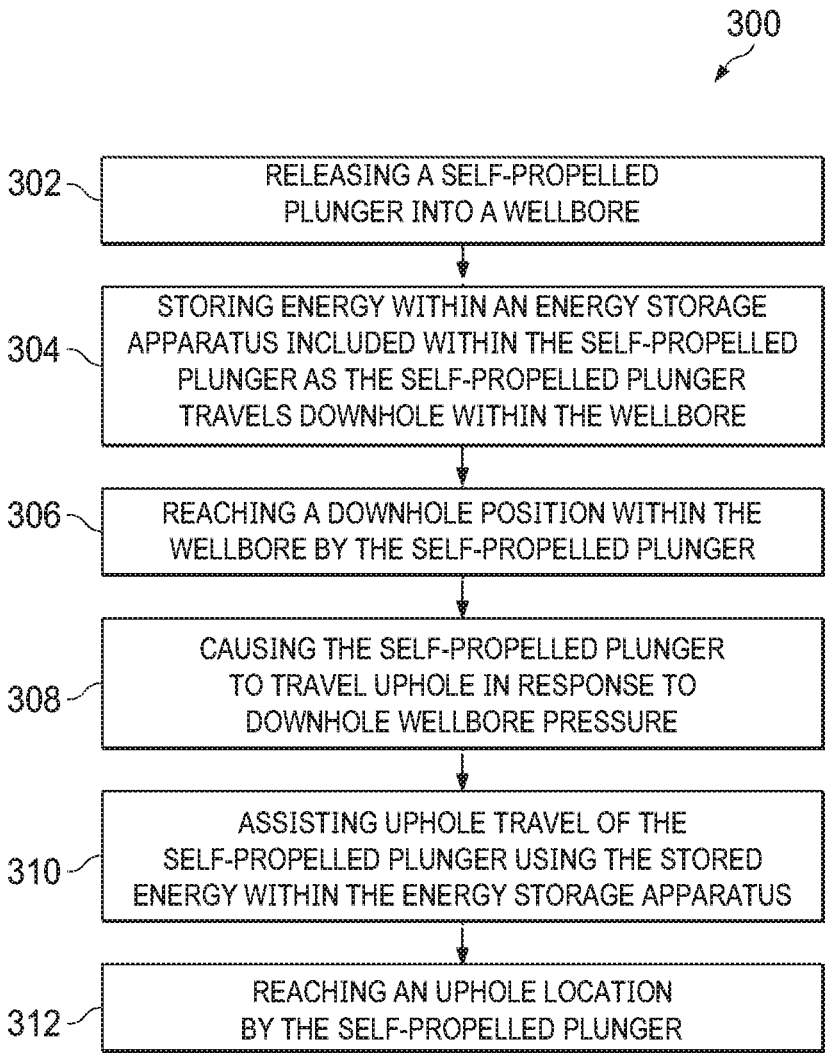
FIG. 3 is a flowchart of an example artificial lift method using a self-propelled plunger, according to some implementations of the present disclosure.

FIG. 3 is a flowchart of an example method 300 of an artificial lift system that includes a self-propelled plunger for lifting a volume of liquid, such as water or oil. The plunger lift system may be operable to lift the volume of liquid to a surface of the earth. The self-propelled plunger may be similar to plunger 112 described earlier or another plunger within the scope of the present disclosure. At 302, the self-propelled plunger is releasing into a wellbore, such as into a production string of a wellbore. At 304, energy is stored within an energy storage apparatus included with the self-propelled plunger as the self-propelled plunger travels downhole within the wellbore. In some implementations, the energy storage apparatus is a spring and a propeller coupled to the spring. As the self-propelled plunger travels downhole, the propeller may encounter a fluid, such as water or oil, within the wellbore. Relative movement of the fluid around the propeller causes the propeller to rotate in a first direction, thereby compressing the spring. At 306, the self-propelled plunger reaches a downhole position within the wellbore. At 308, the self-propelled plunger travels uphole in response to downhole wellbore pressure. At 310, uphole movement of the self-propelled plunger is assisted by the energy stored in the energy storage apparatus. For example, the compressed spring may expand during uphole travel, which, in turn, causes the propeller to rotate in a second direction, opposite the first direction. Thus, during expansion of the compressed spring, potential energy stored in the spring is converted to kinetic energy corresponding to the rotation of the propeller. The energy stored in the energy storage apparatus, such as the spring, is used to assist in lifting the self-propelled plunger and a volume of liquid, such as oil or water, located uphole of the plunger, to the surface during uphole travel within the wellbore. At 312, the self-propelled plunger reaches the surface. As a result, the volume of liquid uphole of the self-propelled plunger is produced. The downhole travel and subsequent uphole travel of the self-propelled plunger may be repeated any number of times. Further, the self-propelled plunger may include a clutch that is operable to change or restrict a rotational direction of the propeller. For example, upon reaching the downhole location, the clutch may disengage from the shaft such that the propeller is free to rotate in the first or the second direction. Some clutches may be actuated such that the propeller is free to rotate in the second direction but is prevented from rotating in the first direction. Similarly, upon arrival of the self-propelled plunger to the surface, the clutch may be actuated to engage with the shaft such that the propeller is free to rotate in the first direction but is prevented to rotate in the second direction.

In the case that the plunger 112 does not return to the surface (a failed cycle), the nose piece 206 may also be used to retrieve the plunger 112 in the completion string 102. A slickline engages the nose piece 206 so that a user or machine can extract the plunger 112 from the completion string 102.

Figure 4:
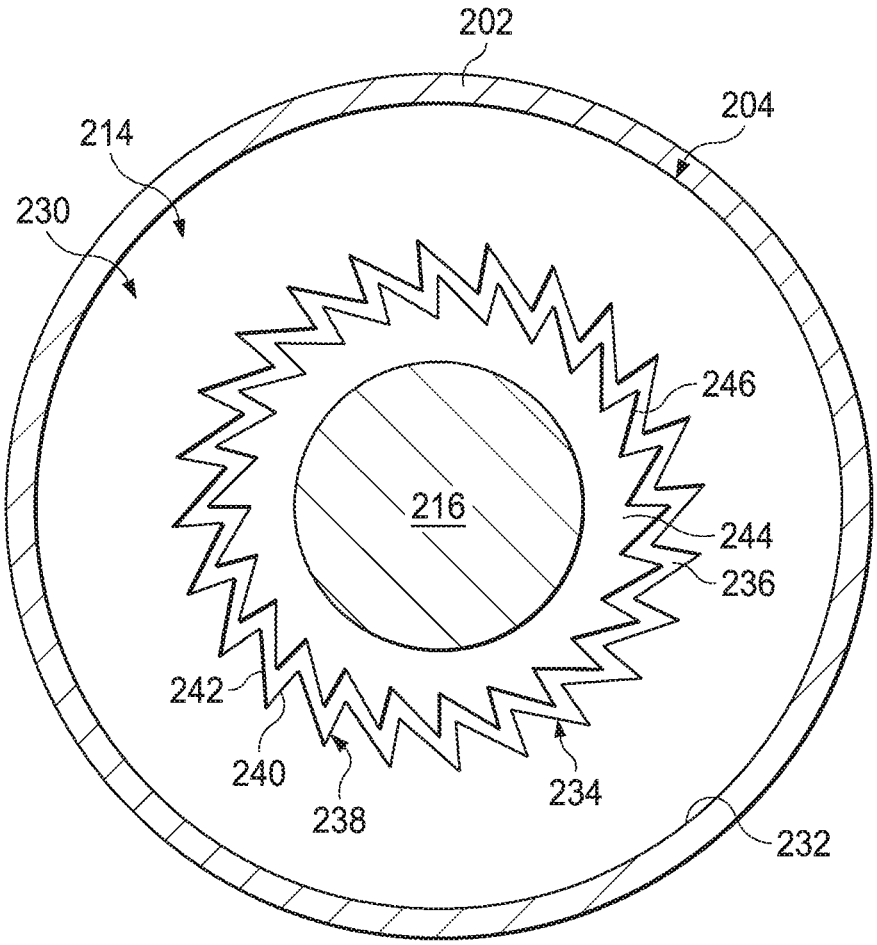
FIG. 4 is a cross-sectional view of the engagement between a shaft of the plunger and a clutch of the plunger.

FIG. 4 shows a longitudinal cross-sectional view of the engagement between the clutch 214 and the shaft 216. The clutch 214 includes a disc 230 having an outer boundary 232 attached to the housing 202 of the plunger 112 and an inner boundary 234 defining an opening 236. The inner boundary 234 of the clutch 214 includes an engagement surface for engaging the shaft 216. The engaging surface of the inner boundary 234, is a saw-tooth pattern have teeth 238. In some clutches, the engagement surface is a ratchet arm. The teeth 238 have vertical side 240 and an angled side 242

The shaft 216 includes an engagement gear 244. Corresponding teeth 246 of the engagement gear 244 mirror the pattern of the engagement surface of the clutch 214. The corresponding teeth 246 are arranged in a complimentary saw-toothed pattern. When the shaft 216 is rotated in the first direction, the corresponding teeth 246 of the shaft 216 ride over the angled side 242 of the teeth 238 of the clutch 214. The shaft 216 transfers this rotational motion to the spring 210, thereby charging (or compressing) the spring 210. When rotated in the second direction, the corresponding teeth 246 of the shaft abut the vertical side 240 of the teeth 238 of the clutch 214 and the shaft 216 is rotationally locked to the clutch 214 (and housing 202) in the second direction. To disengage the clutch 214 and the shaft 216 at the bottom 116 of the completion string 102, the downhole component 114 presses the shaft 216 axially uphole. The engagement gear 244 with the shaft 216 translates uphole until the engagement gear 144 and the disc 230 of the clutch 214 no longer align and the corresponding teeth 246 of the shaft 216 and the teeth 238 of the clutch 214 decouple. The propeller 212 is free to rotate in the first or second direction but is rotated in the second direction by the charged (compressed) spring 210. The plunger 112 moves uphole due to the rotation of the propeller 212 in the second direction. Once the plunger 112 reaches the surface, the nose piece 206 is actuated to realign the engagement gear 244 with the disc 230, for example, by applying an axial downhole force from the nose piece 206 to the shaft 216 via the spring 210. In some plungers, the clutch is directly attached or mounted to the shaft and the clutch is releasably coupled to the housing. The clutch may be engaged with the housing, for example by a saw-tooth connection, as previously described. Some plungers do not include a clutch.

While a mechanical decoupling between the clutch and the shaft by the downhole has been described, the shaft and clutch may also electronically or magnetically decoupled after reaching the bottom of the completion string.

A number of implementations of the present disclosure have been described. Nevertheless, it will be understood that various modifications may be made without departing from the spirit and scope of the present disclosure. For example, a size of the spring may be altered to change an amount of energy that may be stored in the spring. Accordingly, other implementations are within the scope of the following claims.

What is claimed is:

1. A plunger of a plunger lift system, the plunger comprising:

a housing defining an interior cavity, the housing configured to travel between a downhole position in a wellbore and a surface of the earth and configured to displace a volume of fluid uphole of the housing responsive to downhole wellbore pressure;

a spring positioned within the interior cavity, the spring configured to transition from a charged state to a relaxed state during uphole travel of the housing to displace the volume of fluid uphole of the housing;

a propeller configured to rotate in a first direction during downhole travel of the housing and in a second direction, opposite the first direction, during uphole travel of the housing; and a shaft positioned within the housing, the shaft comprising:

a first end coupled to the spring, and a second end coupled to the propeller.

2. The plunger of 1, wherein the spring is configured to charge in response to rotation of the propeller in the first direction and to relax in response to rotation of the propeller in the second direction.

3. The plunger of claim 1, further comprising a clutch coupled to the propeller, the clutch configured to engage the shaft such that the clutch restricts a direction of rotation of the propeller in the second direction.

4. The plunger of claim 3, wherein the clutch is configured to disengage the shaft when the housing reaches the downhole position in the wellbore, and wherein the spring is configured to change the direction of rotation of the propeller from the second direction to the first direction when the housing reaches the surface of the earth.

5. The plunger of claim 1, wherein a longitudinal axis of the spring and a longitudinal axis of the housing are parallel to each other.

6. The plunger of claim 5, wherein the longitudinal axis of the spring and the longitudinal axis of the housing are collinear.

7. The plunger of claim 1, wherein the interior cavity is a first interior cavity, wherein the housing further defines a second interior cavity adjacent to the first interior cavity, and wherein the propeller is disposed in the second interior cavity.

8. The plunger of claim 7, wherein the first interior cavity and the second interior cavity are separated by a partition.

9. The plunger of claim 7, further comprising at least one slot formed in a portion of the housing circumscribing the second interior cavity.

10. An artificial lift method comprising:

lowering a plunger from a surface of the earth to a downhole position in a wellbore, the plunger comprising:

a housing configured to travel between the downhole position and the surface;

a cavity formed in the housing;

a spring positioned within the cavity;

a propeller configured to rotate in a first direction during lowering of the plunger and in a second direction, opposite the first direction, during uphole travel of the plunger; and a shaft positioned within the housing, wherein a first end of the shaft is coupled to the spring and a second end of the shaft is coupled to the propeller;

storing energy within the spring while lowering the plunger from the surface to the downhole position; and releasing energy stored within the spring when the plunger travels uphole to displace a volume of fluid uphole of the plunger in response to downhole wellbore pressure.

11. The artificial lift method of claim 10, further comprising:

rotating the propeller in a first direction during lowering of the plunger to store energy within the spring; and rotating the propeller in a second direction, opposite the first direction, during uphole travel of the plunger to release the stored energy within the spring.

12. The artificial lift method of claim 10, further comprising changing a direction of rotation of the propeller between the first direction and the second direction using a clutch coupled to the propeller.

13. The artificial lift method of claim 10, wherein the direction of rotation of the propeller is changed from the first direction to the second direction when the plunger reaches the downhole position in the wellbore and from the second direction to the first direction when the plunger reaches the surface.

14. The artificial lift method of claim 10, wherein the spring is a helical spring, wherein storing energy within the spring comprises charging the helical spring, and wherein releasing the stored energy within the spring comprises relaxing the charged helical spring.

15. An artificial lift method comprising:

moving a plunger located at a downhole position in a wellbore in an uphole direction responsive to wellbore pressure to displace a volume of fluid uphole of the plunger; and releasing energy stored within a spring disposed in the plunger while displacing the volume of fluid in the uphole direction, the released energy assisting to displace the volume of fluid in the uphole direction, wherein releasing energy stored within the spring disposed in the plunger while displacing the volume of fluid in the uphole direction comprises rotating a propeller of the plunger using the released energy to assist in displacing the volume of fluid in the uphole direction.

16. The artificial lift method of claim 15, wherein rotating a propeller of the plunger using the released energy to assist in displacing the volume of fluid in the uphole direction comprises relaxing the spring to rotate the propeller of the plunger.

17. The artificial lift method of claim 15, further comprising storing energy within the spring while the plunger descends in a downhole direction.

* * * * *